US005494352A

United States Patent [19]

L'Estrange, Jr.

[11] Patent Number: 5,494,352

[45] Date of Patent: Feb. 27, 1996

[54] PAINT STIRRING BLADE WITH AN UPPER HANDLE SECTION AND A LOWER SECTION WITH TAPERS AND HOLES THERETHROUGH

[76] Inventor: Frederick P. L'Estrange, Jr., 321 Salem Ct., San Ramon, Calif. 94583

[21] Appl. No.: 345,852

[22] Filed: Nov. 28, 1994

[51] Int. Cl.[6] ..... B01F 13/00

[52] U.S. Cl. ..... 366/343; 15/236.01

[58] Field of Search ..... 366/605, 343, 366/129; 15/236.01

[56] References Cited

U.S. PATENT DOCUMENTS

| | | | |
|---|---|---|---|
| 1,498,509 | 6/1924 | Arnold | 366/343 |
| 2,777,676 | 1/1957 | Carter | 366/129 |
| 4,350,445 | 9/1982 | Olsson | 366/343 |
| 4,884,895 | 12/1989 | Rodgers | 366/605 |
| 4,924,444 | 5/1990 | Castellanos | 366/129 |

*Primary Examiner*—Robert W. Jenkins

[57] ABSTRACT

A paint stirring blade with an upper handle section and a lower section with tapers and holes therethrough comprising a handle having an upper end and a lower end with a plurality of notches along the length thereof on the interior edge; a blade having an upper end and a lower end with an interior edge and an exterior edge and a central longitudinal extent therethrough, the interior edge and the central edge being essentially in alignment with the interior and exterior edges of the handle with the intermediate edge located beneath the notches of the handle and formed integrally therewith; a longitudinal blade on the interior edge of the blade, the longitudinal blade being angled equally inwardly toward the inboard edge to form an angle; and a lower blade formed transversely to the lower edge of the blade with the opposed faces of the lower blade being formed at equal tapering angles forming an angle.

4 Claims, 4 Drawing Sheets

PAINT STIRRING BLADE WITH AN UPPER HANDLE SECTION AND A LOWER SECTION WITH TAPERS AND HOLES THERETHROUGH

BACKGROUND OF THE INVENTION

1. Field of the Invention

The present invention relates to a paint stirring blade with an upper handle section and a lower section with tapers and holes therethrough and more particularly pertains to stirring paint in a can more thoroughly through a blade with contoured edges and holes extending therethrough.

2. Description of the Prior Art

The use of paint stirring blades of a wide variety of designs and configurations is known in the prior art. More specifically, paint stirring blades of a wide variety of designs and configurations heretofore devised and utilized for the purpose of stirring paint while in a can in a more thorough and efficient manner through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,050,678 a containerized liquid stirrer.

U.S. Pat. No. 4,197,017 discloses a paint stirrer paddle.

U.S. Pat. No. Des. 254,418 discloses the design of a paint stirring paddle.

U.S. Pat. No. Des. 265,601 discloses the design of a combined paint paddle and scraper tool.

U.S. Pat. No. Des. 324,629 discloses the design of a paint mixing paddle.

In this respect, the paint stirring blade with an upper handle section and a lower section with tapers and holes therethrough according to the present invention substantially departs from the conventional concepts and designs of the prior art, and in doing so provides an apparatus primarily developed for the purpose of stirring paint in a can more thoroughly through a blade with contoured edges and holes extending therethrough.

Therefore, it can be appreciated that there exists a continuing need for a new and improved paint stirring blade with an upper handle section and a lower section with tapers and holes therethrough which can be used to stir paint in a can more thoroughly through a blade with contoured edges and holes extending therethrough. In this regard, the present invention substantially fulfills this need.

SUMMARY OF THE INVENTION

In view of the foregoing disadvantages inherent in the known types of paint stirring blades of a wide variety of designs and configurations now present in the prior art, the present invention provides an improved paint stirring blade with an upper handle section and a lower section with tapers and holes therethrough. As such, the general purpose of the present invention, which will be described subsequently in greater detail, is to provide a new and improved paint stirring blade with an upper handle section and a lower section with tapers and holes therethrough and method which has all the advantages of the prior art and none of the disadvantages.

To attain this, the present invention essentially comprises a new and improved paint stirring blade comprising, in combination, a handle having an upper end and a lower end with a plurality of notches along the length thereof on the interior edge; a blade having an upper end and a lower end with an interior edge and an exterior edge and a central longitudinal extent therethrough, the central extend and exterior edge being essentially in alignment with the interior and exterior edges of the handle with the central edge located beneath the notches of the handle and formed integrally therewith; a longitudinal cutting edge on the interior edge of the blade, the longitudinal blade being angled equally inwardly toward the inboard edge to form an angle of between about five and ten degrees; a lower blade formed transversely to the lower edge of the blade with the opposed faces of the lower blade being formed at equal tapering angles forming an angle of between about five and ten degrees, the lower blade extending between about twenty and forty percent of the longitudinal length of the blade; a plurality of holes extending through that portion of the blade beneath the handle; and a plurality of supplemental holes formed on the longitudinal tapering portions of the blade in laterally disposed relationship with the apertures beneath the handle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint stirring blade with an upper handle section and a lower section with tapers and holes therethrough which has all the advantages of the prior art paint stirring blades of a wide variety of designs and configurations and none of the disadvantages.

It is another object of the present invention to provide a new and improved paint stirring blade with an upper handle section and a lower section with tapers and holes therethrough which may be easily and efficiently manufactured and marketed.

It is a further object of the present invention to provide a new and improved paint stirring blade with an upper handle section and a lower section with tapers and holes therethrough which is of durable and reliable construction.

An even further object of the present invention is to provide a new and improved paint stirring blade with an upper handle section and a lower section with tapers and holes therethrough which is susceptible of a low cost of manufacture with regard to both materials and labor, and which accordingly is then susceptible of low prices of sale to the consuming public, thereby making such paint stirring blade with an upper handle section and a lower section with tapers and holes therethrough economically available to the buying public.

Still yet another object of the present invention is to provide a new and improved paint stirring blade with an upper handle section and a lower section with tapers and holes therethrough which provides in the apparatuses and methods of the prior art some of the advantages thereof, while simultaneously overcoming some of the disadvantages normally associated therewith.

Still another object of the present invention is to stir paint in a can more thoroughly through a blade with contoured edges and holes extending therethrough.

Lastly, it is an object of the present invention to provide a new and improved paint stirring blade with an upper handle section and a lower section with tapers and holes therethrough comprising a handle having an upper end and a lower end with a plurality of notches along the length thereof on the interior edge; a blade having an upper end and a lower end with an interior edge and an exterior edge and a central longitudinal extent therethrough, the interior edge and the central edge being essentially in alignment with the interior and exterior edges of the handle with the intermediate edge located beneath the notches of the handle and formed integrally therewith; a longitudinal blade on the interior edge of the blade, the longitudinal blade being angled equally inwardly toward the inboard edge to form an angle; and a lower blade formed transversely to the lower edge of the blade with the opposed faces of the lower blade being formed at equal tapering angles forming an angle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
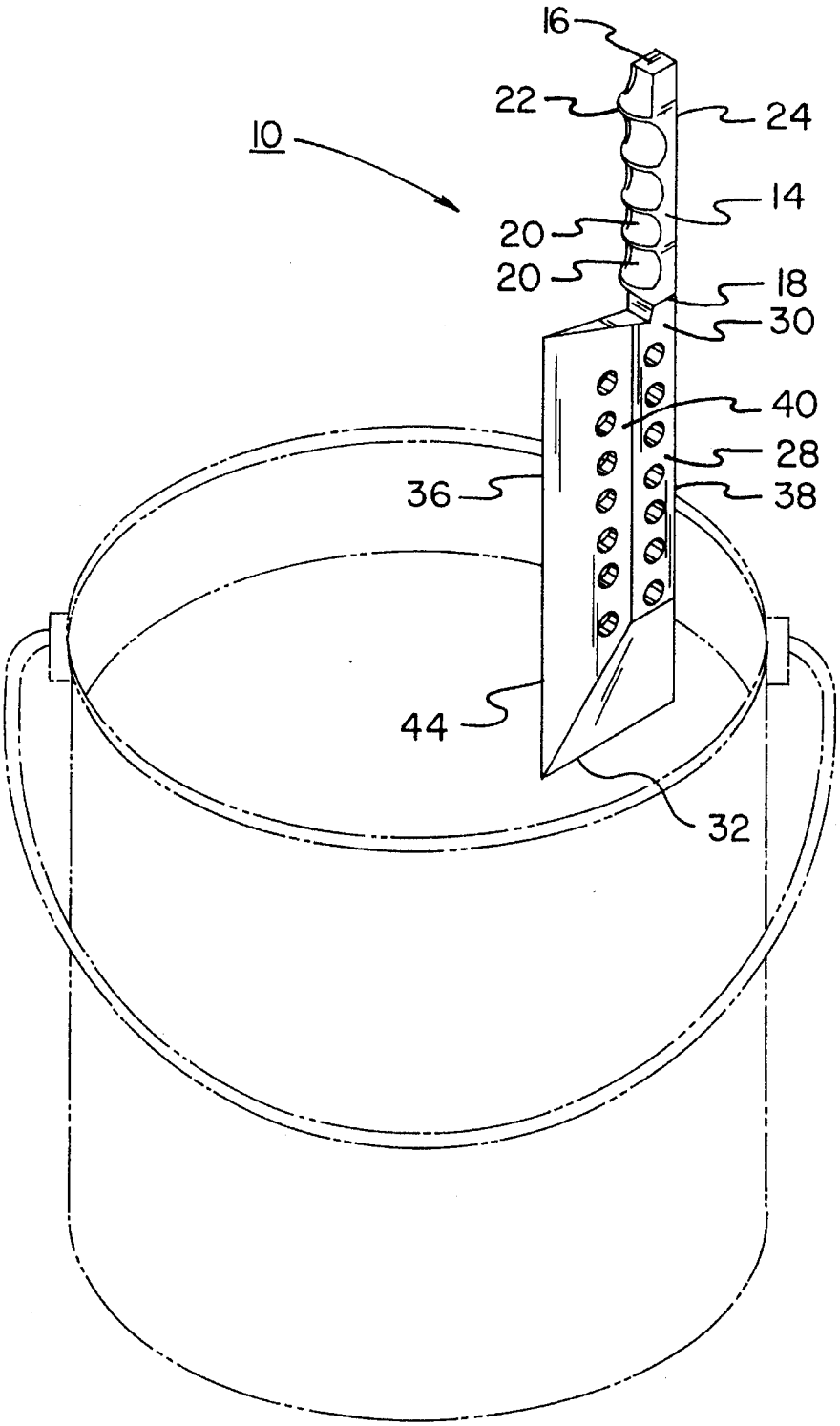
FIG. 1 is a perspective view of the preferred embodiment of the new and improved paint stirring blade with an upper handle section and a lower section with tapers and holes therethrough constructed in accordance with the principles of the present invention.
Figure 2:
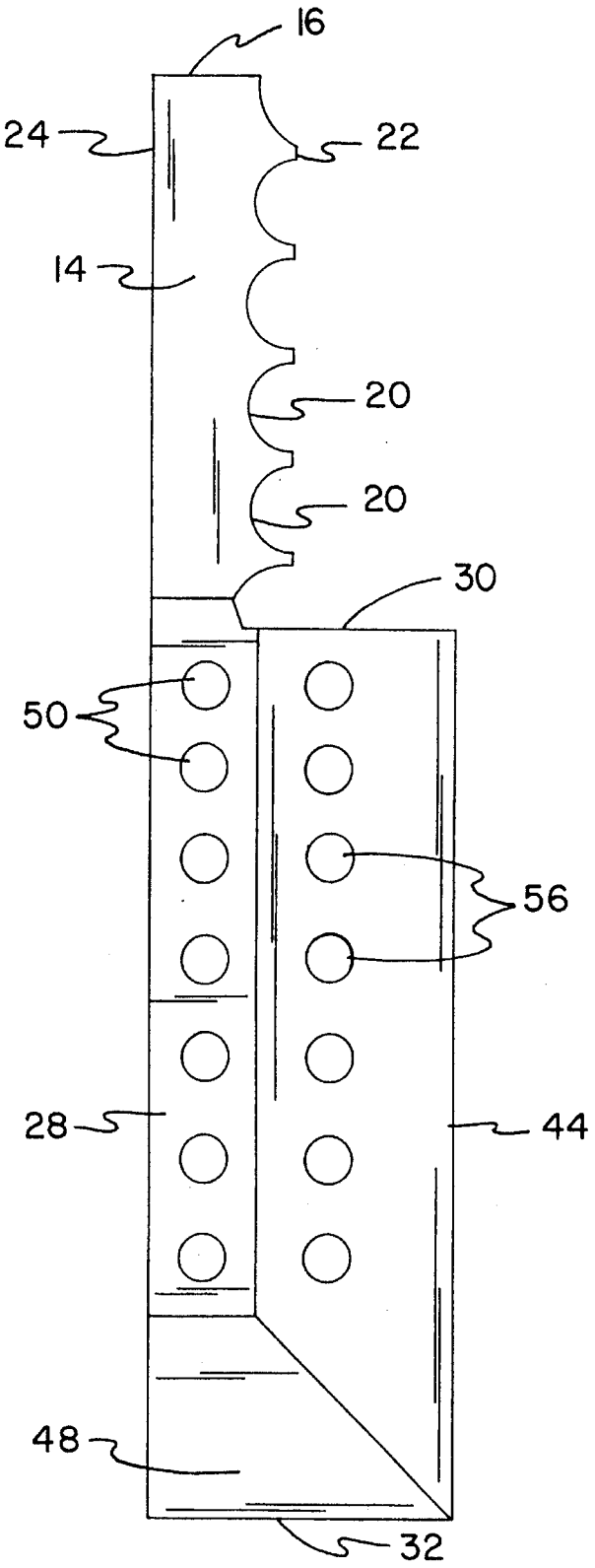
FIG. 2 is a side elevational view of the blade shown in FIG. 1.
Figure 3:
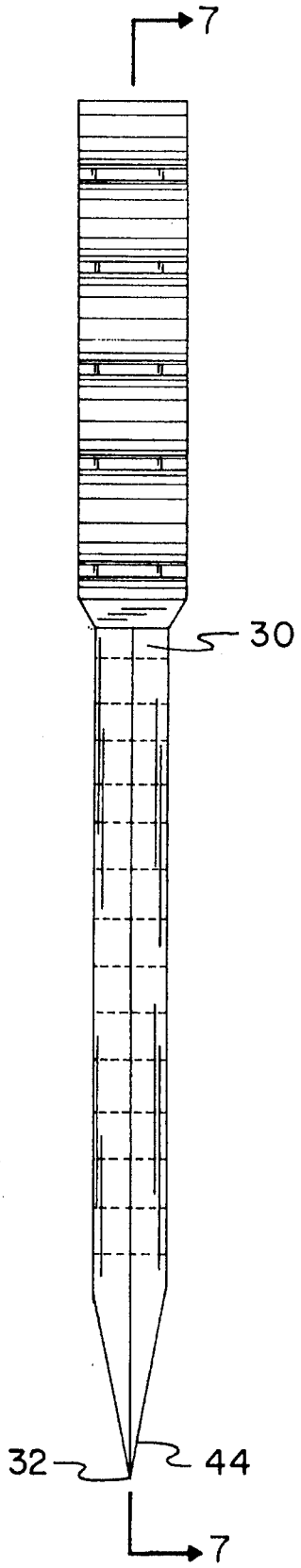
FIG. 3 is an end elevational view of the blade shown in FIGS. 1 and 2.
Figure 4:
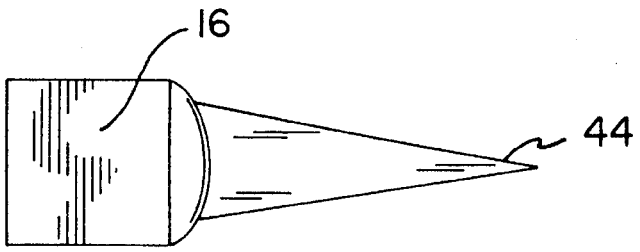
FIG. 4 is a cross-sectional view along through line 4—4 of FIG. 2.
Figure 5:
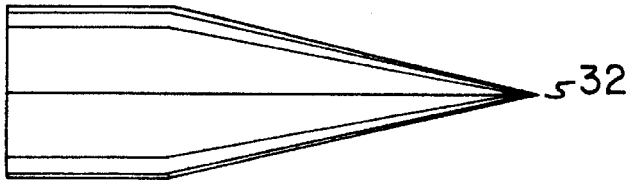
FIG. 5 is a cross-sectional view taken along line 5—5 of FIG. 2.
Figure 6:
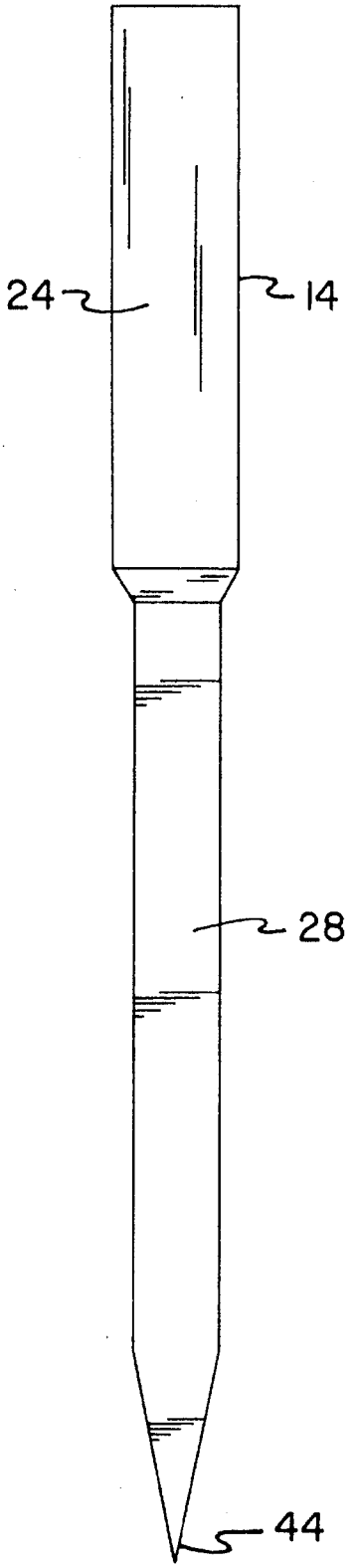
FIG. 6 is a rear elevational view of the blade shown in FIGS. 1, 2 and 3.
Figure 7:
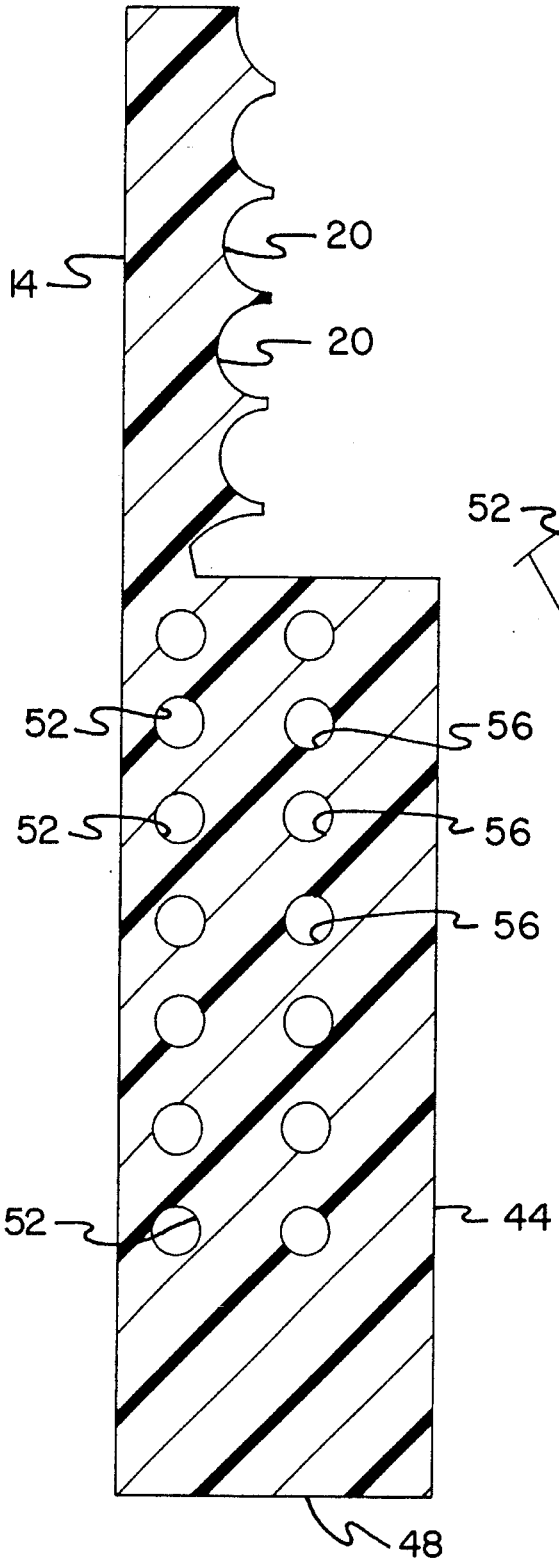
FIG. 7 is a cross-sectional view taken along line 7—7 of FIG. 6.
Figure 8:
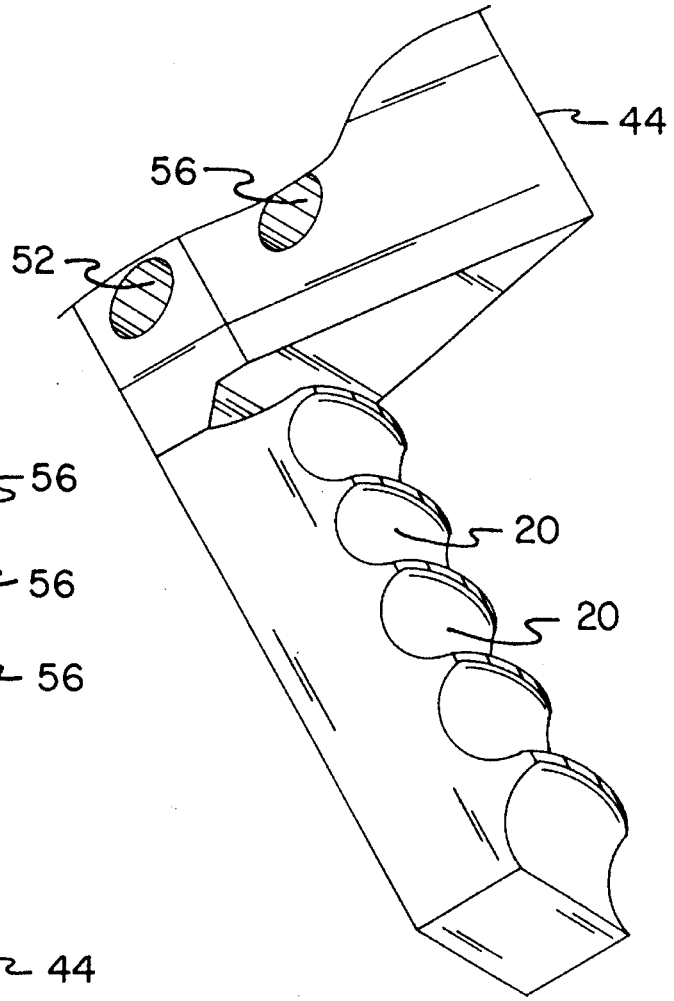
FIG. 8 is an enlarged perspective view of the handle of the device shown in the prior Figures.

With reference now to the drawings, and in particular to FIG. 1 thereof, the preferred embodiment of the new and improved paint stirring blade with an upper handle section and a lower section with tapers and holes therethrough embodying the principles and concepts of the present invention and generally designated by the reference numeral 10 will be described.

The present invention, the new and improved paint stirring blade with an upper handle section and a lower section with tapers and holes therethrough, is comprised of a plurality of components. Such components, in their broadest context, include a handle, blade, cutting edge, lower blade, holes and supplemental holes. Such components are individually configured and correlated with respect to each other so as to attain the desired objective.

The central component of the system 10 of the present invention is a handle 14. The handle has an upper end 16 and a lower end 18. It is formed with a plurality of aligned notches 20. The notches extend along the length of the handle of the interior edge 22. Opposite the interior edge 22 is an essentially parallel exterior edge 24.

The next component of the system 10 is a blade 28. The blade has an upper end 30 and a lower end 32. The blade also has an interior edge 36 and an exterior edge 38. Formed therebetween is a central longitudinal extent 40. The central extent and exterior edge are located essentially in alignment with the interior and exterior edges of the handle. The interior edge is located beneath the notches of the handle. The blade and handle are formed integrally one with respect to the other.

Formed on the blade is a longitudinal cutting edge 44. Such cutting edge is on the interior edge of the blade. The longitudinal blade is angled equally inwardly toward the inboard edge to form an angle of about between five and ten degrees.

Formed at right angles to the longitudinal blade is a lower blade 48. Such lower blade is formed transversely to the lower edge of the blade. It has opposed faces of the lower blade formed at equal tapering angles. Such angles are formed at between about five and ten degrees. The lower blade extends between about twenty and forty percent of the longitudinal length of the blade.

Formed into the blade are a plurality of holes. These include a row of primary holes 52 which extend through that portion of the blade beneath the handle; namely, that portion of the blade which does not taper. In addition, formed in a row parallel with the plurality of primary holes is a plurality of supplemental holes 56. Such supplemental holes are formed on the longitudinal tapering portion of the blade. They are disposed in laterally spaced relationship from the primary apertures beneath the handle.

The present invention comprises a plastic tool, with several holes in its blade, that stirs paint and cleans empty paint containers. It is made of solid molded plastic in one piece, and is shaped much like a butcher's cleaver with a tapered blade that comes to a sharp edge. Seven through holes are located along the length of the blade's flat back edge and seven angled through holes are adjacent and parallel to the first seven at the back of the tapered portion. The angled holes enable directional paint flow while stirring. The finger grip design of its handle facilitates its easy use. It could be made in several sizes for use in different size containers, from one quart to five gallons.

By inserting the present invention into a container of paint and rotating it, it enables the paint to go through the holes in its blade and mixing the paint thoroughly. To clean residual paint out of a nearly empty container, place the present invention on its side, insert the tool's knife edge into it, and rotate the container. Paint will slide off the inside of the can and onto the tool, leaving a can that is almost 100 percent clean, and preventing the waist of paint.

The present invention's angled holes enable easier and more effective mixing of the paint. Its tapered blade facilitates cleaning paint from an almost-empty container. For anyone who works with paint, this is an ideal product.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved paint stirring blade comprising, in combination:

a handle having an upper end, a lower end, an interior edge and an exterior edge, a plurality of notches being positioned along the length of the interior edge;

a blade having an upper end, a lower end, an interior edge, an exterior edge and central longitudinal extent therethrough, the central extent and exterior edge being essentially in alignment with the interior edge and exterior edge of the handle with the central edge located beneath the notches of the handle and formed integrally therewith;

a longitudinal cutting edge on the interior edge of the blade, the longitudinal blade being angled equally inwardly toward the interior edge to form an angle of between about five and ten degrees;

a lower blade formed transversely to the lower edge of the blade with the opposed faces of the lower blade being formed at equal tapering angles forming an angle of between about five and ten degrees, the lower blade extending between about twenty and forty percent of the longitudinal length of the, blade;

a plurality of holes extending through that portion of the blade beneath the handle; and a plurality of supplemental holes formed on the longitudinal tapering portions of the blade in laterally disposed relationship with the apertures beneath the handle.

2. A paint stirring blade with an upper handle section and a lower section with tapers and holes therethrough comprising:

a handle having an upper end and a lower end with a plurality of notches along the length thereof on the interior edge;

a blade having an upper end and a lower end with an interior edge and an exterior edge and a central longitudinal extent therethrough, the central extent and exterior edge being essentially in alignment with the interior and exterior edges of the handle with the central edge located beneath the notches of the handle and formed integrally therewith, a plurality of holes extending through the blade adjacent to the central extent thereof;

a longitudinal cutting edge on the interior edge of the blade, the longitudinal blade being angled equally inwardly toward the inboard edge to form an angle; and a lower blade formed transversely to the lower edge of the blade with the opposed faces of the lower blade being formed at equal tapering angles forming an angle.

3. The blade as set forth in claim 2 wherein the lower blade extends between about twenty and forty percent of the longitudinal length of the blade and a plurality of holes extend through that portion of the blade beneath the handle.

4. The blade as set forth in claim 2 and further including:

a plurality of supplemental holes formed on the longitudinal tapering portions of the blade in laterally disposed relationship with the apertures beneath the handle.

* * * * *